US005212919A

United States Patent [19]

Shaw et al.

[11] Patent Number: 5,212,919

[45] Date of Patent: May 25, 1993

[54] NELSON STUD SCREED POST ASSEMBLY

[76] Inventors: Lee A. Shaw, 1924 Irvine Ave., Newport Beach, Calif. 92660; Ronald D. Shaw, 1988 Pelican, Costa Mesa, Calif. 92626; Thomas W. Enis, 2862 DeForrest Dr., Long Beach, Calif. 90806; Scott G. Shaw, 8206 Pawtucket, Huntington Beach, Calif. 92646; Leroy E. Shaw, 2861 Tobago Pl., Costa Mesa, Calif. 92626

[21] Appl. No.: 882,691

[22] Filed: May 11, 1992

Related U.S. Application Data

[63] Continuation of Ser. No. 647,276, Jan. 28, 1991, abandoned.

[51] Int. Cl.[5] ..... E04B 9/00

[52] U.S. Cl. ..... 52/126.6; 52/365

[58] Field of Search ..... 52/334, 371, 365, 361, 52/370, 369, 126.6; 249/1, 2, 3, 24, 30; 404/114, 118, 119

[56] References Cited

U.S. PATENT DOCUMENTS

| | | | |
|---|---|---|---|
| 1,592,681 | 7/1926 | Grothe . | |
| 1,699,557 | 1/1929 | Yeager . | |
| 1,767,575 | 6/1930 | Bujack . | |
| 1,838,635 | 12/1931 | Pilj . | |
| 1,852,673 | 4/1932 | Pilj . | |
| 1,939,007 | 12/1933 | Heltzel | 25/118 |
| 2,129,568 | 9/1938 | DeBiasi | 72/122 |
| 2,262,704 | 11/1941 | Tompkins et al. | 72/128 |
| 2,319,526 | 5/1943 | Wearn . | |
| 2,331,949 | 10/1943 | Whiteman . | |
| 2,373,284 | 4/1945 | Autry | 72/128 |
| 2,551,826 | 5/1951 | Cox | 52/678 |
| 2,823,539 | 2/1958 | Kersh et al. | 72/128 |
| 3,066,448 | 12/1962 | Pinter | 50/80 |
| 3,284,973 | 11/1966 | Ames et al. | 52/155 |
| 3,333,380 | 8/1967 | Wolf | 52/365 |
| 3,451,179 | 6/1969 | Kendzia | 52/370 |
| 3,920,221 | 11/1975 | Berry et al. | 256/59 |
| 3,921,356 | 11/1975 | Hughes | 52/299 |
| 4,158,937 | 6/1979 | Henry | 52/365 |
| 4,437,828 | 3/1984 | Egger | 425/458 |
| 4,614,070 | 9/1986 | Idland | 52/296 |
| 4,899,497 | 2/1990 | Madl, Jr. | 52/126.6 |
| 4,926,593 | 5/1990 | Johnston | 52/126.4 |

FOREIGN PATENT DOCUMENTS

| | | |
|---|---|---|
| 79813 | 8/1955 | Denmark . |
| 568457 | 10/1975 | Switzerland . |

*Primary Examiner*—Carl D. Friedman
*Assistant Examiner*—Creighton Smith
*Attorney, Agent, or Firm*—Stetina and Brunda

[57] ABSTRACT

A screed post assembly which may be easily and quickly interfaced to a Nelson stud extending upwardly from a horizontal support beam used in the construction of a building framework. The screed post serves as a support for a screed support system which is used to conduct a leveling operation for a concrete pour during the formation of a composite deck.

8 Claims, 3 Drawing Sheets

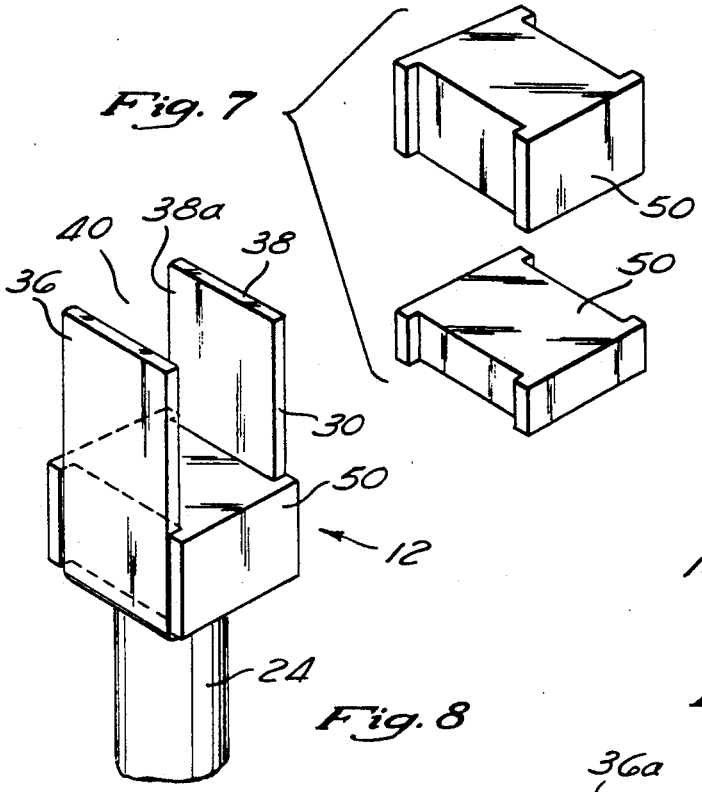
Fig. 7
Fig. 8
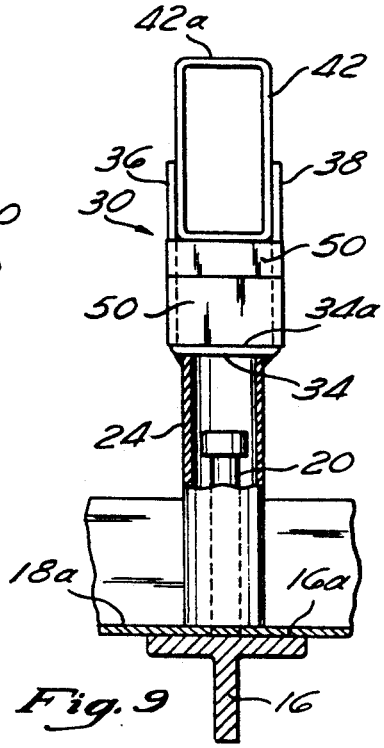
Fig. 9
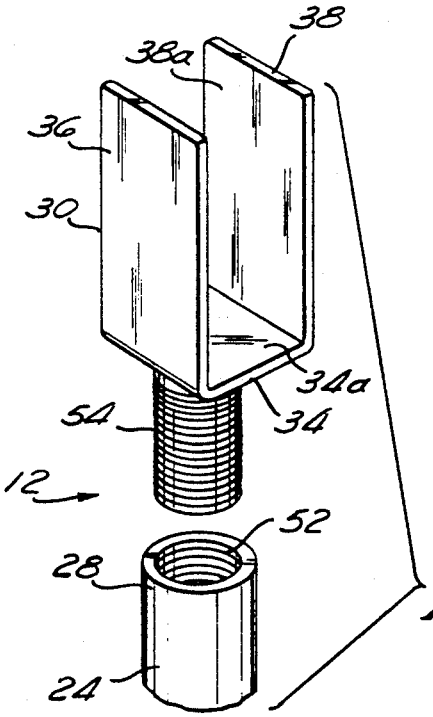
Fig. 10
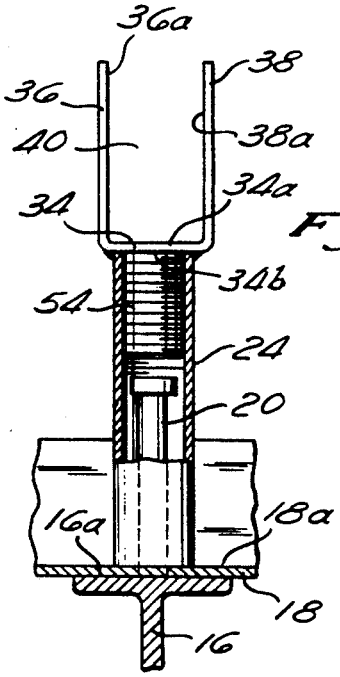
Fig. 11
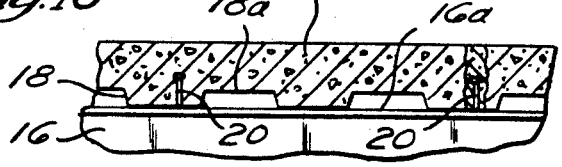
Fig. 12

NELSON STUD SCREED POST ASSEMBLY

This application is a continuation of application Ser. No. 07/647,276, filed Jan. 28, 1990 now abandoned.

FIELD OF THE INVENTION

The present invention relates generally to concrete forming equipment, and more particularly to an improved screed post assembly which is adapted to be attachable to a Nelson stud during the formation of a composite deck.

BACKGROUND OF THE INVENTION

As is well known in the construction industry, many multi-story buildings are fabricated having composite decks. A composite deck is generally formed by the integrated combination of concrete and structural steel. An integral part of modern composite decks is a structural component known as a Nelson stud. Typically, Nelson studs comprise elongate members which are welded to horizontally disposed structural steel beams in a manner wherein the Nelson studs are generally in linear alignment upon and extend vertically upward from the top, horizontal surface of the structural beams to which they are attached. The Nelson studs are usually welded to the structural beams after a layer of corrugated sheet metal decking has been placed across the top surfaces of the beams. In this respect, the lower end of each Nelson stud is abutted against the upper surface of the metal decking in a position approximately above the longitudinal axis of the beam. Since the metal decking has a relatively thin cross-section, the welding procedure is operable to form an integral connection between the Nelson stud, metal decking and top surface of the beam. Concrete is then poured upon the upper surface of the corrugated sheet metal decking in a manner such that the concrete completely surrounds the exposed portions of each of the Nelson studs. The interconnection of the structural steel beams, the corrugated sheet metal decking, the Nelson studs and the concrete pour serve to form the composite deck.

In composite deck construction, a certain concrete thickness is specified for the concrete poured upon the metal decking. As can be appreciated, the concrete thickness throughout the entire surface area of the composite deck must be uniform, thereby necessitating that the pour be leveled in a manner achieving such uniform thickness. The leveling device used to level concrete pours is referred to as a screed. In composite deck construction, the screed extends between and is attached to a pair of screed rails. The screed rails are connected to adjacent, parallel support beams in a manner wherein each screed rail is generally parallel to the support beam to which it is attached. Each screed rail is connected to its respective support beam by at least two screed post assemblies, the screed rail extending between the screed post assemblies. The screed is then drawn along the length of the screed rails to level the surface of the pour.

Screed post assemblies as currently known, generally comprise a screed pad having a screed post extending upwardly therefrom. Such screed post assemblies, however, are not well suited for use in conjunction with the construction of composite decks. In this respect, prior art screed post assemblies require that the screed pad be attached to the corrugated sheet metal decking by means of screws and,,or adhesives. Once the screed pad is anchored to the metal decking, the screed post is threadably connected to the screed pad and the screed rail is pinch bolted to the screed post. The screed post height must then be established typically by optical leveling procedures and subsequently the screed post is then interfaced to the screed rail and subsequently drawn over the surface of the concrete pour.

As can be appreciated, the use of the aforementioned screed support system, though serving to level the concrete pour, requires a great deal of labor and time to implement. Additionally, use of the aforementioned screed support system also requires that special procedures be implemented to insure that the screed is disposed in a level orientation in relation to the support beams. Such procedures include the use of an optical measuring device which is both costly, time consuming and difficult. Thus, there exists a need in the art for an improved screed support system which may be easily installed and used during the construction of composite decks.

SUMMARY OF THE INVENTION

In accordance with the preferred embodiment of the present invention, there is provided a screed post which is connectable to a Nelson stud and serves as part of a support system to be used in the construction of composite decks. The screed post assembly generally comprises an elongate screed post having a first end and a second end. In the preferred embodiment, the second end of the screed post is adapted to receive the Nelson stud in a manner whereby the screed post extends vertically upwardly from the top, horizontal surface of the support beam to which the Nelson stud is connected. Disposed on the second end of the screed post is a screed rail support channel. The support channel generally comprises a middle portion which has a generally planar upper surface and a lower surface. Extending perpendicularly from the upper surface of the middle portion is a first flange portion which has a generally planar first inner surface and a second flange portion which has a generally planar second inner surface substantially parallel to the first inner surface of the first flange portion. Importantly, the upper surface of the middle portion, the first inner surface and the second inner surface define a generally U-shaped recess for slidably receiving a screed rail.

In the preferred embodiment, the support channel includes means for adjusting the distance separating the screed rail from the upper surface of the middle portion when the screed rail is disposed within the U-shaped recess of the screed post assembly. In a first embodiment of the present invention, the adjusting means comprises a plurality of apertures formed in the first flange portion and second flange portion. The apertures in the first flange portion and second flange portion are disposed in coaxial alignment. A quick release pin member is slidably insertable between pairs of horizontally aligned apertures and adapted to support the screed rail above the upper surface of the middle portion of the support channel. In a second embodiment, the adjusting means comprises one or more shim members which are sized and configured to be slidably received into and maintained within the U-shaped recess. The shim member(s) are maintained within the recess in a manner whereby the shim member(s) separate the screed rail from the upper surface of the middle portion a distance corresponding to the height of the shim member(s). According to a third embodiment of the present invention the height adjustment of the screed rail is facilitated by the threaded interconnection of the support channel to the screed post.

During the construction of a composite deck, four screed post assemblies of the present invention, each being preferably identically configured according to one of the three embodiments previously described, are interfaced to four different Nelson studs. In this regard, a first pair of screed posts are interfaced to a first pair of Nelson studs attached to a first support beam. The first pair of screed posts are connected to the Nelson studs in a manner whereby each screed post assembly comprising the first pair of screed posts extends vertically upwardly from the top, horizontal surface of the first support beam. Similarly, a second pair of screed posts are interfaced to a second pair of Nelson studs attached to a second support beam in the manner a previously described with respect to the first pair of screed posts. It will be appreciated that the first and second elongate support beams are horizontally oriented and disposed adjacent each other in generally parallel relation. Additionally, the screed posts comprising the first pair and the screed posts comprising the second pair are separated by identical distances on their respective support beams such that a screed post attached to a Nelson stud on the first support beam is in general horizontal (i.e. level) alignment with a screed post attached to a Nelson stud on the second support beam.

A first elongate screed rail is attached to and extends between the first pair of screed posts. Similarly, a second elongate screed rail is attached to and extends between the second pair of screed posts. An elongate screed having a first end and a second end is then extended horizontally between and interfaced to the first screed rail and second screed rail in a manner wherein the screed may be slidably drawn along the length of the first screed rail and the second screed rail. In the preferred embodiment, the first screed rail and the second screed rail each have a generally rectangular cross-sectional configuration and define a generally planar top surface. In this respect, the first end of the screed includes a first tab member extending outwardly therefrom which is adapted to be in sliding contact with at least a portion of the top surface of the first screed rail. Additionally, the second end of the screed includes a second tab member extending outwardly therefrom which is adapted to be in sliding contact with at least a portion of the top surface of the second screed rail.

Because each of the screed posts comprising the first pair and the second pair are identically configured to include one of three adjustment means as previously described, the height of either or both the first screed rail and the second screed rail may be easily and quickly adjusted in relation to the desired pour thickness. Advantageously, because the steel support beams are already disposed in a level orientation, the attachment of the screed support assembly to the horizontal support beams in the manner as previously described rapidly disposes the screed in a horizontal level orientation thereby eliminating the need for conducting specialized procedures to facilitate such a horizontal level screed orientation. Thus, by drawing the screed along the length of the first and second screed rails, the concrete pour disposed under the screed may be easily and quickly leveled. After the concrete pour has set, each of the four screed post assemblies are removed from the pour and portions of cement inserted into the holes left thereby to complete the construction of the composite deck.

It is thereafter an object of the present invention to provide a screed post assembly for use during the construction of composite decks wherein the screed post assembly is attachable to a Nelson stud.

Another object of the present invention is to provide a screed post assembly for use during the construction of composite decks wherein the screed post is adapted to allow the screed height to be easily and quickly adjusted.

Another object of the present invention is to provide a screed post assembly for use during the construction of composite decks which is adapted to place the screed in a level orientation without the need for specialized alignment techniques.

BRIEF DESCRIPTION OF THE DRAWINGS

These as well as other features of the present invention will become apparent upon reference to the drawings wherein:

FIG. 7 is a perspective view of two shim members which may be used as an alternative to the quick release pin adjustment member shown in FIGS. 5 and 6;

FIG. 8 is a perspective view illustrating the manner in which the shim members of FIG. 7 are interfaced to a screed post assembly constructed in accordance with a second embodiment of the present invention;

FIG. 9 is a cross-sectional view illustrating the manner in which the shim members of FIGS. 7 and 8 are used to elevate the height of a screed rail when the screed post assembly of the second embodiment is interfaced to a Nelson stud;

FIG. 10 is an exploded view illustrating a third embodiment of the screed post assembly wherein the support channel of the screed post assembly is threadably interfaced to the screed post;

FIG. 11 is a cross-sectional view illustrating the manner in which the screed post assembly of the third embodiment as shown in FIG. 10 is interfaced to a Nelson stud; and FIG. 12 is a cross-sectional view showing the manner in which the Nelson studs are interfaced to the concrete pour after completion of the composite deck and the apertures which remain in the pour after removing a screed post assembly from the composite deck.

DESCRIPTION OF THE PREFERRED EMBODIMENT

Figure 1:
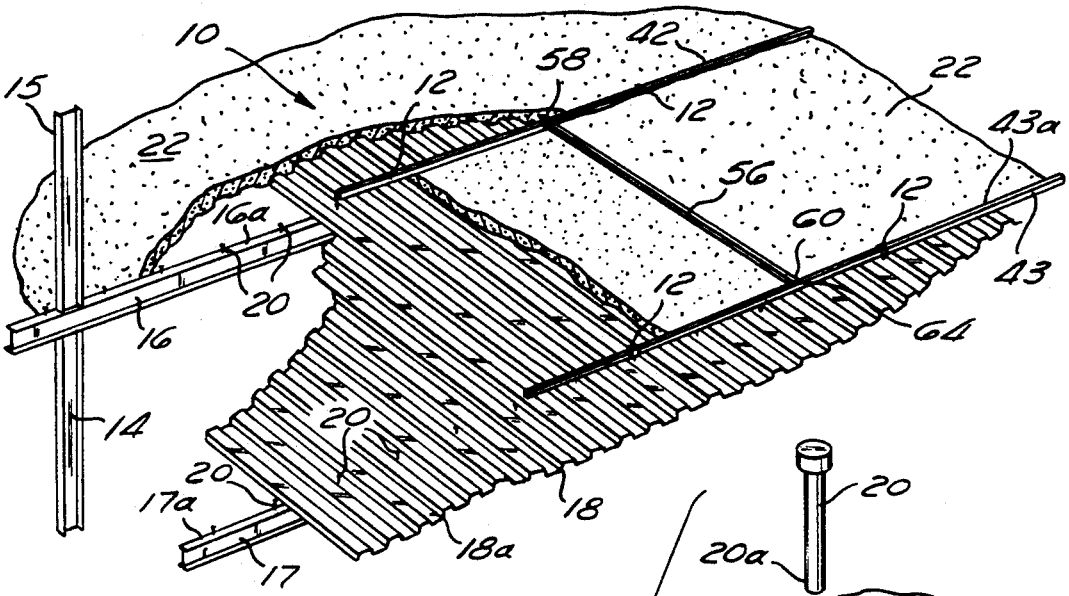
FIG. 1 is a perspective view illustrating the manner in which the screed post assembly of the present invention is used in conjunction with a screed support system to conduct a leveling operation of a concrete pour during the construction of a composite deck.

Referring now to the drawings wherein the showings are for purposes of illustrating preferred embodiments of the present invention only and not for purposes of limiting the same, FIG. 1 perspectively illustrates the manner in which a composite deck is fabricated using a screed support system 10 which incorporates a screed post assembly 12 constructed in accordance with one of three embodiments of the present invention. As is well known in the construction industry, composite decks are often used in the construction of multi-level buildings. In the construction of such buildings, a steel framework for the building is first constructed which comprises a plurality of vertically disposed support columns 14, 15 which are interconnected to a plurality of horizontally disposed support beams 16, 17. Typically, vertical support columns 14, 15 and horizontal support beams 16, 17 comprise steel I-beams which are welded together. In fabricating the composite deck, a layer of corrugated sheet metal decking 18 is placed upon the top surfaces 16*a*, 17*a* of adjacent, parallel support beams 16, 17 in a manner thereby the metal decking 18 extends across the open area defined between support beams 16, 17. The sheet metal decking 18 is then affixed as by spot welding to the horizontal support beams 16, 17 to maintain the metal decking 18 thereon.

Figure 2:
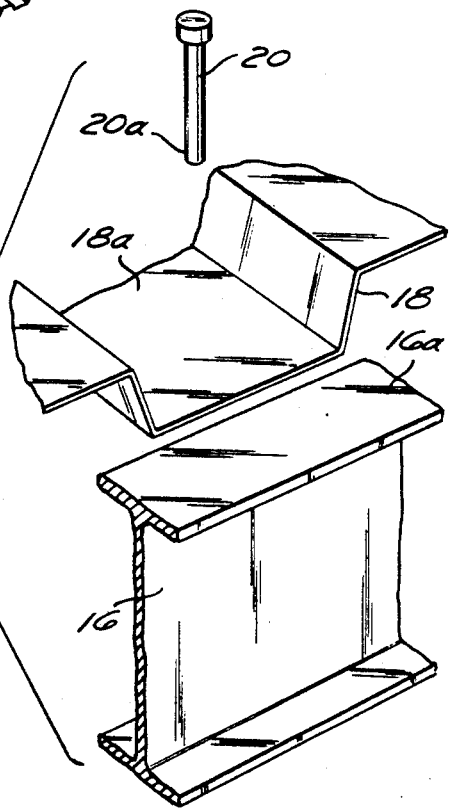
FIG. 2 is a perspective view of the Nelson stud, corrugated metal decking, and steel support beam of the composite deck.
Figure 3:
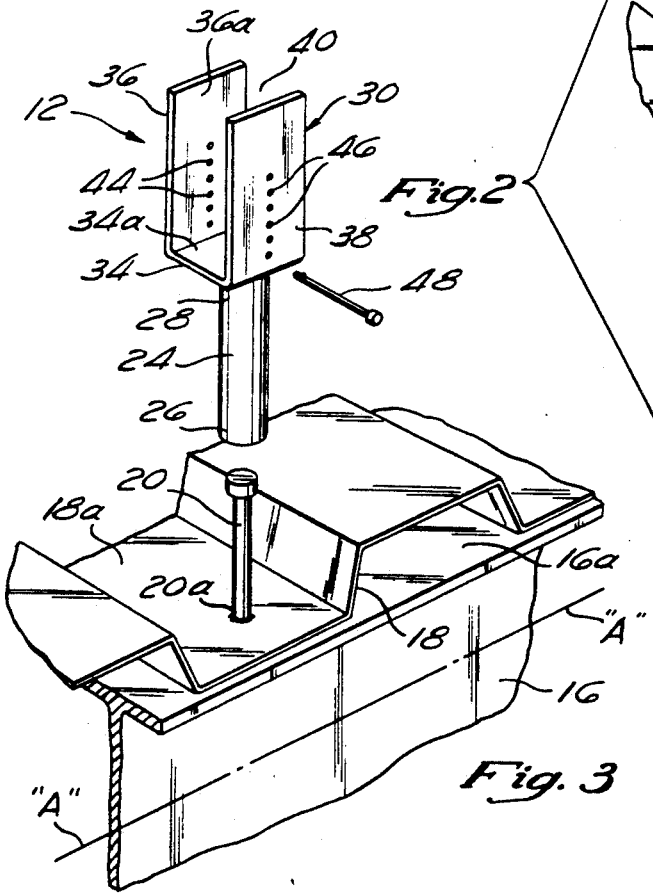
FIG. 3 is a perspective view illustrating both the manner in which the corrugated sheet metal decking, steel support beam and Nelson stud as shown in FIG. 2 are interfaced and a screed post assembly constructed in accordance with a first embodiment of the present invention.

A plurality of elongate metal studs 20 known as Nelson studs are then fillet welded to portions of the upper surface 18*a* of metal decking 18 in a manner wherein Nelson studs 20 are in general linear alignment upon and extend vertically upwardly from top surfaces 16*a*, 17*a* of support beams 16, 17. In this regard, the lower end 20*a* of each Nelson stud 20 is abutted against the upper surface 18*a* of metal decking 18 in a position which is in general vertical alignment with a longitudinal axis extending through the center of horizontal support beams 16, 17 (e.g. axis "A" of beam 16 as seen in FIG. 3). Since metal decking 18 has a relatively thin cross-section (as seen in FIG. 2), the welding process is operable to integrally connect metal decking 18 and Nelson stud 20 to the top, horizontal surfaces 16*a*, 17*a* of support beams 16, 17 in the manner shown in FIG. 5. It will be appreciated that each Nelson stud 20 used in constructing the building framework is interfaced to a respective sheet of metal decking and a respective horizontal support of the framework in the manner as previously described. After the affixation of Nelson studs 20 to metal decking 18 and horizontal support beams 16, 17 has been completed, a layer of concrete 22 is poured upon the upper surface 18*a* of metal decking 18. As seen in FIG. 12, the concrete pour 22 completely surrounds each of Nelson studs 20. Thus, since each Nelson stud 20 is integrally connected to metal decking 18 and horizontal support beams 16, 17 the integral connection of the concrete pour 22 to each Nelson stud 20 is operable to form the composite deck. As can be appreciated, a necessary step of forming the composite deck in a proper manner is to insure that concrete pour 22 has a uniform height and is level relative to the top surfaces 16*a*, 17*a* of the horizontal support beams 16, 17.

Figure 4:
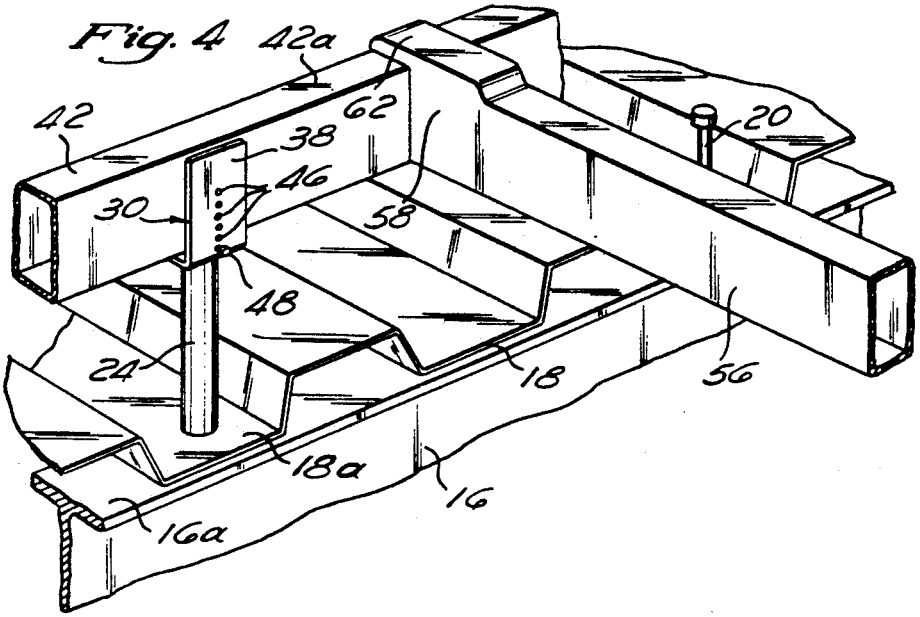
FIG. 4 is a perspective view illustrating the manner in which a screed rail and screed are interfaced to a screed post assembly.
Figure 5:
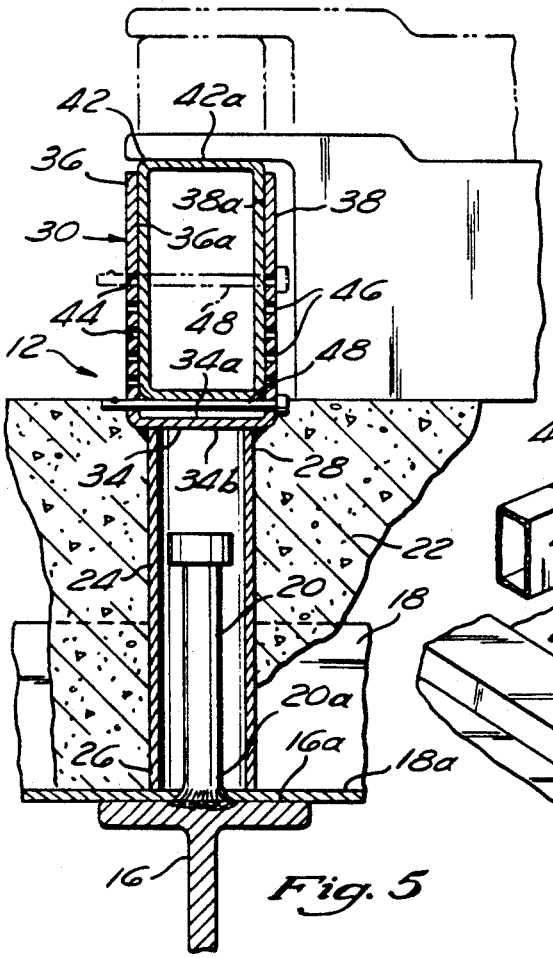
FIG. 5 is a cross-sectional view illustrating the manner in which a quick release pin adjustment mechanism is operable to adjust the height of the screed over a concrete pour when the screed post assembly constructed in accordance with the first embodiment is interfaced to a Nelson stud.

To facilitate the proper leveling of the concrete pour 22, the screed support system 10 of the present invention is interfaced to the Nelson studs 20 by using a screed post assembly 12 constructed in accordance with the present invention. Referring now to FIGS. 3-5, screed post assembly 12 generally comprises an elongate screed post 24 having a first end 26 and a second end 28. First end 26 is sized to receive (i.e. extend over) a Nelson stud 20 in a manner whereby screed post 24 extends vertically upwardly from upper surface 18*a* of metal decking 18. In the preferred embodiment, screed post 24 comprises a tubular member which is interfaced to a Nelson stud 20 and metal decking 18 in the manner best seen in FIG. 5. Thus, when interfaced to Nelson stud 20, first end 26 of screed post 24 is directly abutted against upper surface 18*a* of metal decking 18. Connected to second end 28 of screed post 24 is a screed rail support channel 30. Support channel 30 generally comprises a middle portion 34 having an upper surface 34*a* and a lower surface 34*b*. In this respect, in the first and second embodiments, second end 28 of screed post 24 is welded to lower surface 34*b* of middle portion 34. Extending perpendicularly from upper surface 34*a* of middle portion 34 is a first flange portion 36 having a generally planar first inner surface 36*a* and a second flange portion 38 having a generally planar second inner surface 38 which is substantially parallel to first inner surface 36*a* of first flange portion 36. Upper surface 34*a* of middle portion 34, first inner surface 36*a* and second inner surface 38*a* define a generally U-shaped recess 40.

Figure 6:
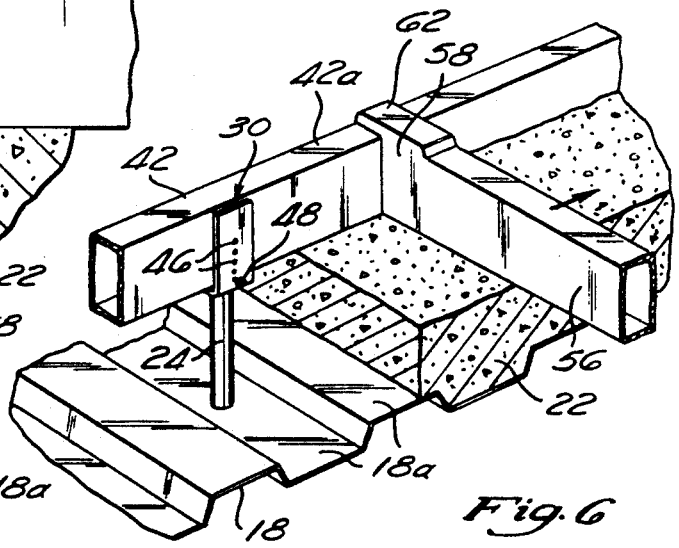
FIG. 6 is a perspective view illustrating the manner in which the screed is used to level concrete after being poured upon the upper surface of corrugated sheet metal decking.

The U-shaped recess 40 is sized and configured to slidably receive a conventional elongate screed rail 42 in the manner best seen in FIGS. 4 and 6. Screed rail 42 preferably has a generally rectangular cross-sectional configuration and defines a generally planar top surface 42*a*. The use of screed rail 42 will be explained in greater detail below.

The support channel 30 of screed post assembly 12 includes a mechanism for rapidly adjusting the distance separating upper surface 34*a* of middle portion 34 from screed rail 42 when screed rail 42 is disposed within U-shaped recess 40. According to a first embodiment of the present invention, the adjustment mechanism generally comprises a first set of apertures 44 formed in the first flange portion 36 and a second set of apertures 46 formed in the second flange portion 38. As seen in FIG. 3, the apertures comprising first set 44 and second set 46 are in generally vertical, linear alignment and symmetrically spaced such that each aperture comprising first set 44 is coaxially aligned with a respective aperture comprising second set 46. A quick-release pin member 48 is slidably insertable between pairs of coaxially aligned apertures. When screed rail 42 is received into U-shaped recess 40, screed rail 42 rests directly against pin member 48. Thus, pin member 48 may be moved between horizontally aligned pairs of apertures to adjust the distance separating upper surface 34*a* of middle portion 34 from screed rail 42 in the manner seen in FIG. 5.

Referring now to FIGS. 7-9, as an alternative to first set of apertures 44, second set cf apertures 46 and pin member 48, illustrated is a second embodiment of the present invention wherein support channel 30 is interfaced with one or more shim members 50 to facilitate the height adjustment of screed rail 42. As seen in FIG. 8, each of shim members 50 is adapted to be slidably receivable into U-shaped recess 40 and interfaced to first flange portion and second flange portion 38 in a manner wherein shim members 50 may not move laterally within U-shaped recess 40. Shim members 50 are thus operable to separate upper surface 34*a* of middle portion 34 from screed rail 42 a distance equal to the height of the shim members disposed within U-shaped recess 40, as seen in FIG. 9. In the preferred embodiment, shim members 50 are color coded in a manner wherein each of shim members 50 are given a color corresponding to their particular height.

Referring now to FIGS. 10 and 11, in accordance with a third embodiment of the present invention, support channel 30 may be threadably interconnected to screed post 24. As previously specified, screed post 24 generally comprises a tubular member. In this respect, to facilitate the threaded interconnection between support channel 30 and screed post 24, at least a portion of the inner diameter of screed post 24 adjacent second end 28 includes a female thread 52 disposed therein. Additionally, support channel 30 includes a male threaded member 54 extending vertically downwardly from the lower surface 34*b* of middle portion 34. Male threaded member 54 is fabricated so as to be threadably receivable into female thread 52 of screed post 24. Importantly, male threaded member 54 is sized such that it will not contact Nelson stud 20 when threadably connected to screed post 24, as seen in FIG. 11. It will be appreciated that the threaded interconnection of support channel 30 to screed post 24 may be used an alternative to the pin member and shim member adjustment mechanisms as previously discussed in relation to the first and second embodiments. In this respect, support channel 30 may be rotated in a manner facilitating the height adjustment of middle portion 34 and hence the height adjustment of screed rail 42 when disposed within U-shaped recess 40.

Having thus described the configuration of screed post assembly 12, the manner in which screed post assembly 12 constructed in accordance with any of the three embodiments is used to form the improved screed support system 10 for constructing composite decks may be described. Screed support system 10 generally contemplates the use of four identically configured screed post assemblies, each screed post assembly 12 being fabricated in accordance with one of the embodiments as previously described (i.e. including a pin member, shim members, or threadable interconnection). Referring now to FIGS. 1, 4 and 6, a first pair of screed post assemblies are interfaced to a first pair of Nelson studs 20 extending upwardly from top, horizontal surface 16*a* horizontal support beam 16. The first pair of screed post assemblies are interfaced to the Nelson studs 20 by coaxially positioning their lower ends over the Nelson studs 20 and lowering the assembly downward thereupon. As such, each screed post assembly pair 12 extends vertically upwardly from the top, horizontal surface 16*a* of the support beam 16. Similarly, a second pair of screed post assemblies are interfaced to a second pair of Nelson studs 20 extending upwardly from top, horizontal surface 17*a* of an adjacent support beam 17, the second pair of screed post assemblies being connected to the second pair of Nelson studs 20 in the same manner as previously described, wherein each screed post assembly 12 extends vertically upwardly from the top, horizontal surface 17*a* of the horizontal support beam 17. Screed rail 42 may then be attached to and extend between the first pair of screed post assemblies while a second screed rail 43, having a configuration identical to screed rail 42 may be attached to and extend between the second pair of the screed post assemblies. As will be recognized, due to the support beams 16 and 17 being disposed in a horizontal level orientation during earlier erection of the building structure, the support channels 30 of the screed assemblies will necessarily be disposed in a similar level orientation. As such conventional optical leveling systems to set the level of the screed support assembly upon the structure is eliminated.

Subsequently, the height of the desired concrete pour may be facilitated by use of one of the three embodiments of the mechanisms for adjusting the distance separating the upper surface 34*a* of middle portion 34 from the decking 18/beam 16. Further, if desired, a suitable drainage grade for the pour can be provided by adjusting the relative heights between the screed post assemblies. With the desired pour height determined, concrete is poured upon the decking 18 in the area between the screed rails 42 and 43.

An elongate screed 56 having a first end 58 and a second 60 is then positioned horizontally between screed rail 42 and the second screed rail 43 in a manner in which screed 56 may be slidably drawn along the length of screed rail 42 and second screed rail 43 in the manner shown in FIG. 6. In this respect, the sliding movement cf screed 56 along screed rail 42 and second screed rail 43 is operable to level concrete pour 22. The interconnection between screed 56 and screed rails 42, 43 is facilitated by a first tab member 62 which extends outwardly from first end 58 of screed 56 and a second tab member 64 which extends outwardly from second end 60. In this respect, first tab member 62 is adapted to be in sliding contact with at least a top portion of top surface 42*a* of screed rail 42 while second tab member 64 is adapted to be in sliding contact with at least a portion of the top surface 43*a* of second screed rail 43.

After concrete pour 22 has been completely leveled, screed 56 is removed from between the screed rail 42 and second screed rail 43, and screed rail 42 is removed from the first pair of screed post assemblies while second screed rail 43 is removed from the second pair of screed post assemblies. Each screed post assembly 12 is then removed from the concrete pour 22. Subsequently, each screed post assembly 12 may be repositioned on adjacent support beams to complete the pour.

Additional modifications and improvements of the present invention may also be apparent to those skilled in the art. Thus, the particular combination of parts described and illustrated herein is intended to represent only one embodiment of the invention, and is not intended to serve as limitations of alternative devices within the spirit and scope of the invention.

What is claimed is:

1. An apparatus for leveling a concrete pour during construction of a composite deck comprising:

a first pair of screed posts interfaced to a first pair of studs integral with and extending perpendicularly upward from a top, horizontal surface of a first support beam, each of the screed posts of said first pair including a tubular portion having a top end and a bottom end for receiving a respective one of the studs of the first pair, said tubular portion being sized and configured to be extensible over and completely receive a respective one of the studs of the first pair of studs in a manner wherein the bottom end of each tubular portion is abutted against the horizontal surface of said first support beam and each screed post of the first pair extends vertically upward therefrom;

a second pair of screed posts interfaced to a second pair of studs integral with and extending perpendicularly upward from a top, horizontal surface of a second support beam, each of the screed posts of said second pair including a tubular portion having a top end and a bottom end for receiving a respective one of the studs of said second pair, said tubular portion being sized and configured to be extensible over and completely receive a respective one of the studs of the second pair of studs in a manner wherein the bottom end of each tubular portion is abutted against the horizontal surface of said second support beam and each screed post of the second pair extends vertically upward therefrom;

a first elongate screed rail attached to and extending between said first pair of screed posts;

a second elongate screed rail attached to and extending between said second pair of screed posts; and an elongate screed extending horizontally between and being slidably positionable along the length of said first and second screed rails.

2. The device of claim 1 wherein each of said screed posts comprising said first pair includes a first adjustment means for adjusting the height of said first screed rail relative the top surface of said first support beam, and each of said screed posts comprising said second pair includes a second adjustment means for adjusting the height of said second screed rail relative the top surface of said second support beam.

3. The device of claim 2 wherein the top end of the tubular portion of each of the screed posts of said first and second pairs has a generally U-shaped support channel disposed thereon for receiving a respective one of the screed rails, said support channel comprising a lower portion having first and second generally planar flange portions extending perpendicularly upward from opposed sides thereof in substantially parallel relation.

4. The device of claim 3 wherein said first and second adjustment means comprise:

a first set of apertures disposed in the first flange portion of each support channel in vertical, linear alignment;

a second set of apertures disposed in the second flange portion of each support channel in vertical, linear alignment, each of the apertures of said second set being coaxially aligned with a corresponding aperture of said first set; and a pin member slidably insertable between a coaxially aligned pair of apertures of said first and second sets, said pin member being sized to support a respective one of said screed rails in an orientation above the lower portion of the support channel.

5. The device of claim 3 wherein said first and second adjusting means comprise at least one shim member slidably positionable between the first and second flange portions of each support channel, said shim member being operable to separate a respective one of said screed rails from the lower portion of the support channel a distance corresponding to the height of said shim member.

6. The device of claim 3 wherein said support channel is threadably connected to the top end of said tubular portion.

7. An apparatus for leveling a concrete pour during construction of a composite deck comprising:

a first pair of screed posts interfaced to a first pair of studs integral with and extending perpendicularly upward from a top, horizontal surface of a first support beam, each of the screed posts of said first pair including a tubular portion having a top end and a bottom end for receiving a respective one of the studs of the first pair, said tubular portion being sized and configured to be extensible over and completely receive a respective one of the studs of the first pair of studs in a manner wherein each screed post of the first pair extends vertically upward from said horizontal surface of said first support beam;

a second pair of screed posts interfaced to a second pair of studs integral with and extending perpendicularly upward from a top, horizontal surface of a second support beam, each of the screed posts of said second pair including a tubular portion having a top end and a bottom end for receiving a respective one of the studs of said second pair, said tubular portion being sized and configured to be extensible over and completely receive a respective one of the studs of the second pair in a manner wherein each screed post of the second pair extends vertically upward from said horizontal surface of said second support beam;

a first elongate screed rail attached to and extending between said first pair of screed posts;

a second elongate screed rail attached to and extending between said second pair of screed posts;

an elongate screed extending horizontally between and being slidably positionable along the length of said first and second screed rails;

a generally U-shaped support channel disposed on the top end of the tubular portion of each of said screed posts of said first and second pairs for receiving a respective one of the screed rails, said support channel comprising a lower portion having first and second generally planar flange portions extending perpendicularly upward from the opposed sides thereof in substantially parallel relation;

a first set of apertures disposed in the first flange portion of each support channel in vertical, linear alignment;

a second set of apertures disposed in the second flange portion of each support channel in vertical, linear alignment, each of the apertures of said second set being coaxially aligned with the corresponding apertures of the first set; and a pin member slidably insertable between a coaxially aligned pair of apertures of said first and second sets, said pin member being sized to support a respective one of said screed rails in an orientation above the lower portion of the support channel;

the first and second sets of apertures and pin members of the screed posts comprising said first pair being used to selectively adjust the height of said first screed rail relative the top surface of said first support beam, and the first and second sets of apertures and pin members of the screed posts comprising said second pair being used to selectively adjust the height of said second screed rail relative the top surface of said second support beam.

8. An apparatus for leveling a concrete pour during construction of a composite deck comprising:

a first pair of screed posts interfaced to a first pair of studs integral with and extending perpendicularly upward from a top, horizontal surface of a first support beam, each of the screed posts of said first pair including a tubular portion having a top end and a bottom end for receiving a respective one of the studs of said first pair, said tubular portion being sized and configured to be extensible over and completely receive a respective one of the studs of the first pair in a manner wherein each screed posts of the first pair extends vertically upward from said horizontal surface of said first support beam;

a second pair of screed posts interfaced to a second pair of studs integral with and extending perpendicularly upward from a top, horizontal surface of a second support beam, each of the screed posts of said second pair including a tubular portion having a top end and a bottom end for receiving a respective one of the studs of said second pair, said tubular portion being sized and configured to be extensible over and completely receive a respective one of the studs of the second pair in a manner wherein each screed post of the second pair extends vertically upward from said horizontal surface of said second support beam;

a first elongate screed rail attached to and extending between said first pair of screed posts; as second elongate screed rail attached to and extending between said second pair of screed posts;

an elongate screed extending horizontally between and being slidably positionable along the length of said first and second screed rail;

a generally U-shaped support channel disposed on the top end of the tubular portion of each of said screed posts of said first and second pairs for receiving a respective one of the screed rails, said support channel comprising a lower portion having first and second generally planar flange portions extending perpendicularly upward from the opposed sides thereof in substantially parallel relation;

at least one shim member slidably positionable between the first and second flange portions of each support channel, said shim member being operable to separate a respective one of said screed rails from the lower portion of the support channel a distance corresponding to the height of said shim member;

the shim members of the screed posts comprising said first pair being used to selectively adjust the height of said first screed rail relative the top surface of said first support beam, and the shim members of the screed posts comprising said second pair being used to selectively adjust the height of said second screed rail relative the top surface of said second support beam.

* * * * *